US007631599B2

(12) United States Patent
Shimizu et al.

(10) Patent No.: US 7,631,599 B2
(45) Date of Patent: Dec. 15, 2009

(54) SHEET GUIDE APPARATUS

(75) Inventors: You Shimizu, Ibaraki (JP); Koichi Ohrui, Ibaraki (JP)

(73) Assignee: Komori Corporation, Tokyo (JP)

( * ) Notice: Subject to any disclaimer, the term of this patent is extended or adjusted under 35 U.S.C. 154(b) by 159 days.

(21) Appl. No.: 11/452,021

(22) Filed: Jun. 12, 2006

(65) Prior Publication Data

US 2007/0000400 A1 Jan. 4, 2007

(30) Foreign Application Priority Data

Jun. 16, 2005 (JP) ..... 2005-176122

(51) Int. Cl.

| | |
|---|---|
| ***B41F 13/24*** | (2006.01) |
| ***B41F 22/00*** | (2006.01) |
| ***B65H 29/24*** | (2006.01) |
| ***B65H 5/02*** | (2006.01) |
| ***B65H 5/04*** | (2006.01) |

(52) U.S. Cl. ..... 101/232; 101/420; 271/276; 271/195

(58) Field of Classification Search ..... 101/232, 101/231, 420, 53; 271/275, 276, 195
See application file for complete search history.

(56) References Cited

U.S. PATENT DOCUMENTS

| | | | | |
|---|---|---|---|---|
| 2,714,485 | A * | 8/1955 | Goettl | 416/187 |
| 3,465,088 | A * | 9/1969 | Kohls | 84/702 |
| 4,967,661 | A | 11/1990 | Duarte | |
| 5,599,013 | A * | 2/1997 | Detmers et al. | 271/195 |
| 5,626,075 | A * | 5/1997 | Detmers et al. | 101/232 |
| 5,816,155 | A | 10/1998 | Stephan | |
| 6,477,951 | B2 * | 11/2002 | Fujimoto | 101/232 |
| 6,899,327 | B2 * | 5/2005 | Shimizu et al. | 271/276 |

FOREIGN PATENT DOCUMENTS

| | | |
|---|---|---|
| DE | 103 18 971 | 12/2003 |
| EP | 1 123 803 | 8/2001 |
| JP | 62-191352 A | 8/1987 |
| JP | 10-109404 A | 4/1998 |
| JP | 2001-354345 A | 12/2001 |

* cited by examiner

*Primary Examiner*—Judy Nguyen
*Assistant Examiner*—Leo T Hinze
(74) *Attorney, Agent, or Firm*—Blakely, Sokoloff, Taylor & Zafman LLP

(57) ABSTRACT

A sheet guide apparatus includes a transfer cylinder, first vane members, and a lateral air blowing guide. The transfer cylinder conveys a sheet. The first vane members are arranged at at least one end of the transfer cylinder and rotate together with the transfer cylinder to discharge air in a radial direction. The lateral air blowing guide is arranged close to the transfer cylinder and discharges air from the first vane members toward the sheet which is conveyed as the transfer cylinder rotates.

12 Claims, 4 Drawing Sheets

SHEET GUIDE APPARATUS

BACKGROUND OF THE INVENTION

The present invention relates to a sheet guide apparatus which is used by a transfer cylinder or the like in a sheet-fed offset rotary printing press to regulate fluttering or the like of a sheet.

In a sheet guide apparatus in a sheet-fed offset rotary printing press, when a sheet to be conveyed by rotation of a transfer cylinder serving as a transport cylinder is thin, the trailing edge of the sheet flutters during conveyance due to low rigidity of the sheet. When the sheet is thick, the trailing edge of the sheet is separated from the transfer cylinder by the centrifugal force acting on the sheet under conveyance to come into contact with a sheet guide.

As shown in Japanese Patent Laid-Open No. 10-109404, a conventional sheet guide apparatus comprises an air duct which comes close to the outer surface of a transfer cylinder to serve as a sheet guide, and an air discharge nozzle which is arranged on the upper-side surface of the air duct to discharge air from a portion corresponding to the center of a sheet under conveyance toward two sides in the widthwise direction of the sheet. In this arrangement, air discharged from the air discharge nozzle forms an air flow layer between the upper-side surface of the air duct and the sheet under conveyance so as to convey the sheet with its trailing edge being in a stable state.

The conventional sheet guide apparatus described above requires a driving source which drives a fan to supply air to be discharged from the air discharge nozzle, leading to a high manufacturing cost. A driving system is also required to make the structure complicated. An installation space to install the driving source and an air supply system is also required to make the apparatus bulky.

SUMMARY OF THE INVENTION

It is an object of the present invention to provide a sheet guide apparatus in which the manufacturing cost is reduced.

It is another object of the present invention to provide a sheet guide apparatus in which the structure is simplified and the space is reduced.

In order to achieve the above objects, according to the present invention, there is provided a sheet guide apparatus comprising a transport cylinder which conveys a sheet, a first vane member which is arranged at at least one end of the transport cylinder and rotates together with the transport cylinder to discharge air in a radial direction, and sheet guide means, arranged close to the transport cylinder, for discharging air from the first vane member toward the sheet which is conveyed as the transport cylinder rotates.

DESCRIPTION OF THE PREFERRED EMBODIMENTS

A sheet guide apparatus according to the first embodiment of the present invention will be described with reference to FIGS. 1 to 6.

Figure 1:
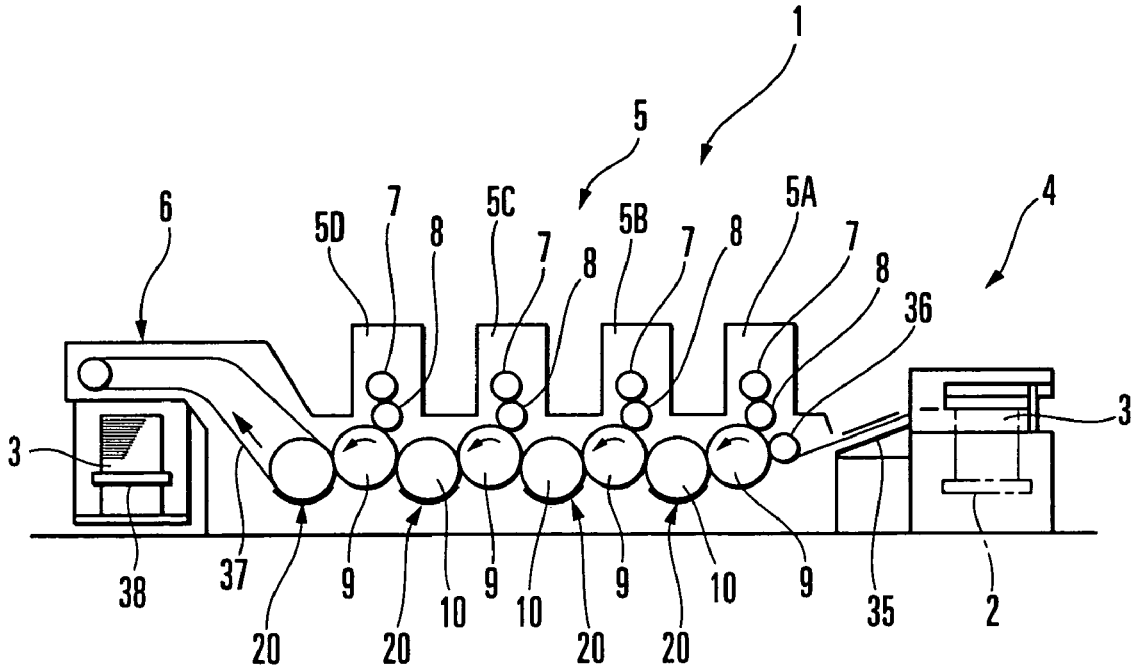
FIG. 1 is a view showing the schematic arrangement of a sheet-fed offset rotary printing press to which the present invention is applied.

A sheet-fed offset rotary printing press 1 shown in FIG. 1 comprises a feeder 4 which feeds one by one sheets 3 stacked on a pile board 2, a printing unit 5 including four printing units 5A to 5D which print on a sheet 3 fed from the feeder 4, and a delivery unit 6 to which the sheet 3 printed by the printing unit 5 is delivered. Each of the printing units 5A to 5D comprises a plate cylinder 7 to which ink and water are respectively supplied from an inking device (not shown) and a dampening unit (not shown), a blanket cylinder 8 which is in contact with the plate cylinder 7, and an impression cylinder 9 which is in contact with the blanket cylinder 8 to convey the sheet 3 to it.

Figure 2:
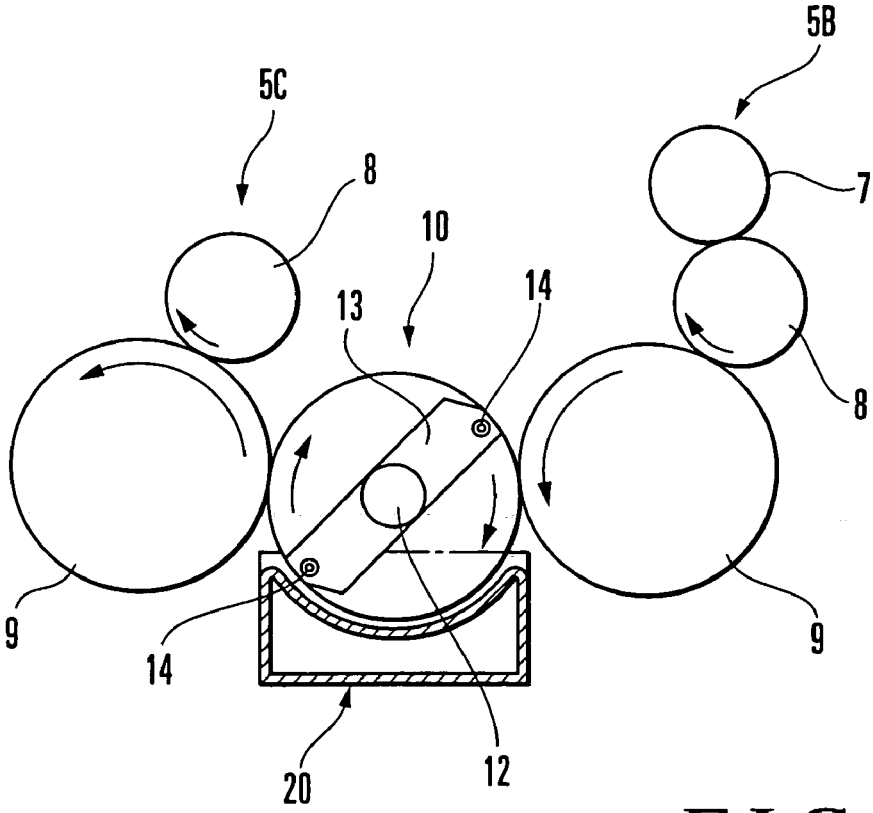
FIG. 2 is a partially cutaway sectional view of a sheet guide apparatus according to the first embodiment of the present invention.

Skelton-type transfer cylinders 10 (transport cylinders) are arranged between the impression cylinders 9 of the printing units 5A to 5D. As shown in FIG. 2, each transfer cylinder 10 has a shaft 12 which is rotatably supported by a pair of frames (not shown), a rotary body 13 which is fixed to the shaft 12 and has a rectangular section, and gripper devices 14 which are arranged at the two ends of the rotary body 13 in the radial direction to grip the sheet 3.

Figure 4:
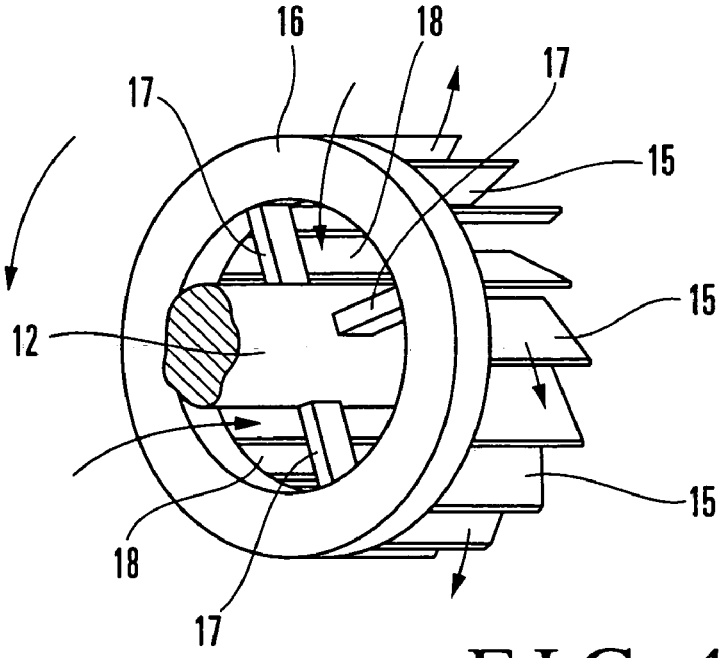
FIG. 4 is a perspective view of the end portion of the transfer cylinder shown in FIG. 3.

A large number of first vane members 15 are arranged at the two ends of the transfer cylinder 10. The first vane members 15 supply air in the axial direction of the transfer cylinder 10, when the transfer cylinder 10 rotates, so as to serve as axial fans. This will be described in detail. Ring-like rims 16 concentric with the shaft 12 are arranged at the two ends of the shaft 12, as shown in FIG. 4. Each rim 16 is connected to the shaft 12 with four spokes 17. The spokes 17 are arranged equiangularly in the circumferential direction of the rim 16 radially from the shaft 12 toward the rim 16.

Portions between the adjacent spokes 17 form air suction ports 18. A total of four air suction ports 18 are formed in one end of the shaft 12. The plurality of first vane members 15 projecting in the axial direction of the shaft 12 are fixed to the rim 16 equiangularly in the circumferential direction of the rim 16. As the first vane members 15, plate members which are inclined at predetermined angles inwardly from the outside with respect to the rotational direction of the shaft 12 are attached equiangularly with respect to the circumferential direction of the rim 16. When the transfer cylinder 10 rotates, the first vane members 15 rotate integrally to intake air in the transfer cylinder 10 through the air suction ports 18, and discharge the air outwardly in the radial direction of the first vane members 15.

Figure 7:
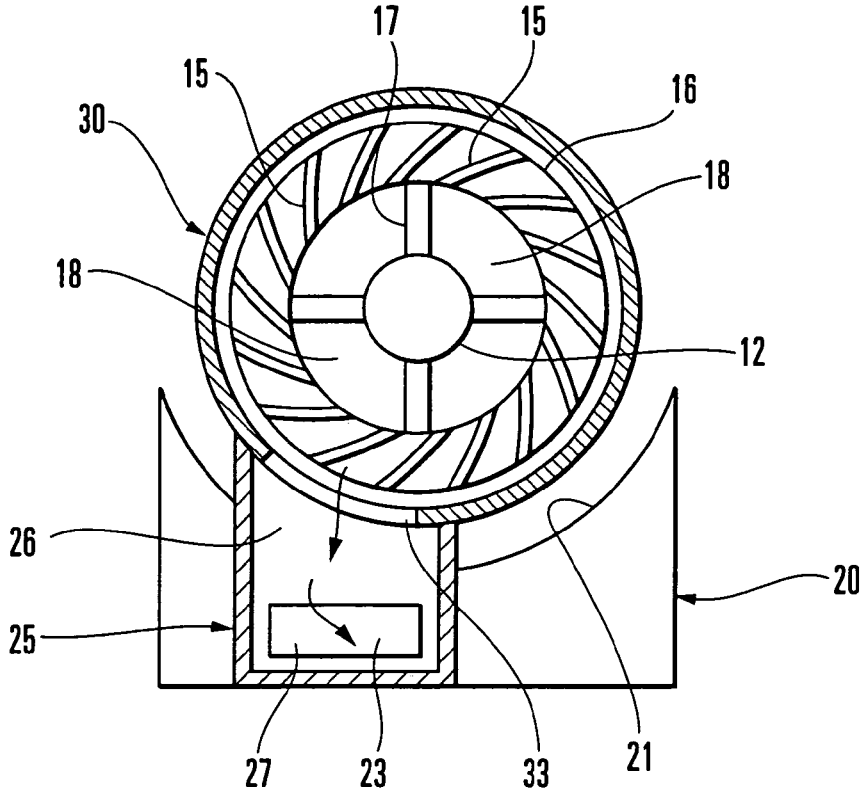
FIG. 7 is a sectional view showing another example of the vane member shown in FIG. 5.

The first vane members are not limited to mere inclined plates, but may be arcuate members having curved surfaces instead of inclination, as shown in FIG. 7, or twisted members the angles of inclination of which partly differ between the inner and outer sides of the rim 16.

Figure 3:
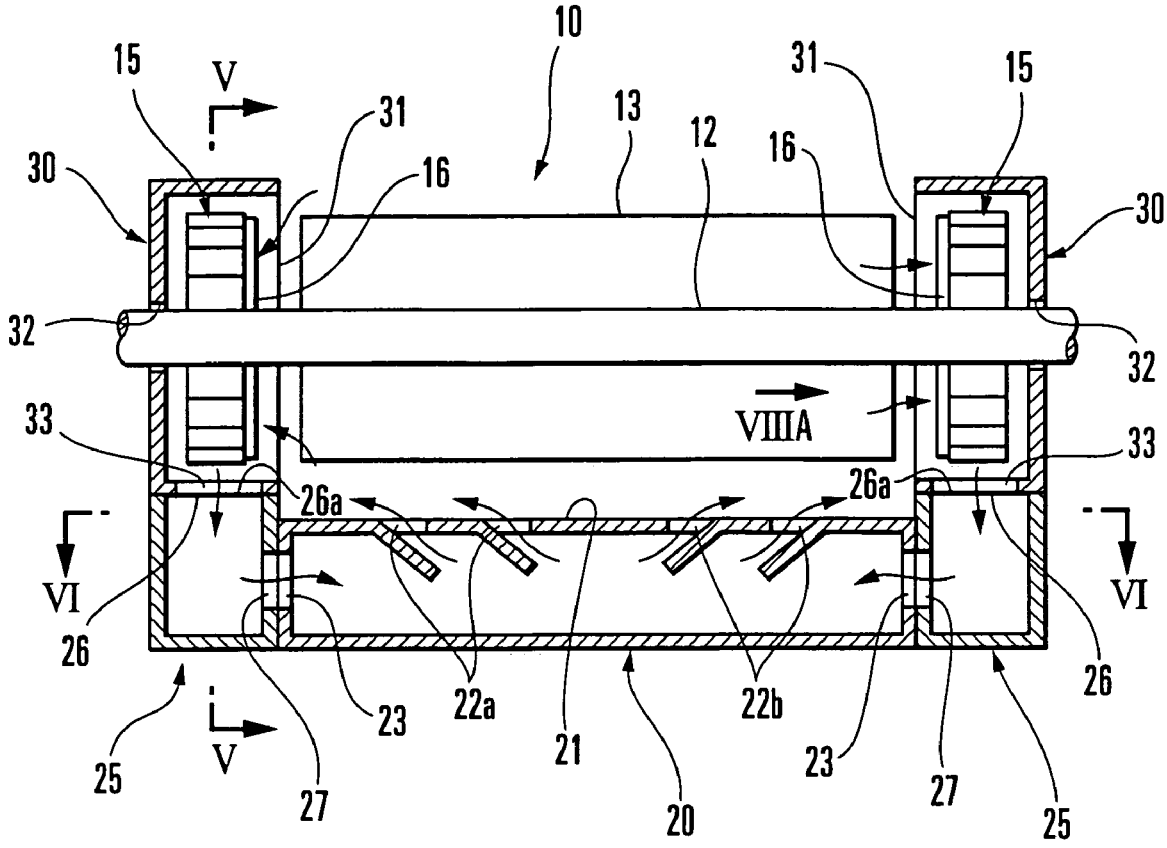
FIG. 3 is a longitudinal sectional view of the sheet guide apparatus shown in FIG. 2.
Figure 5:
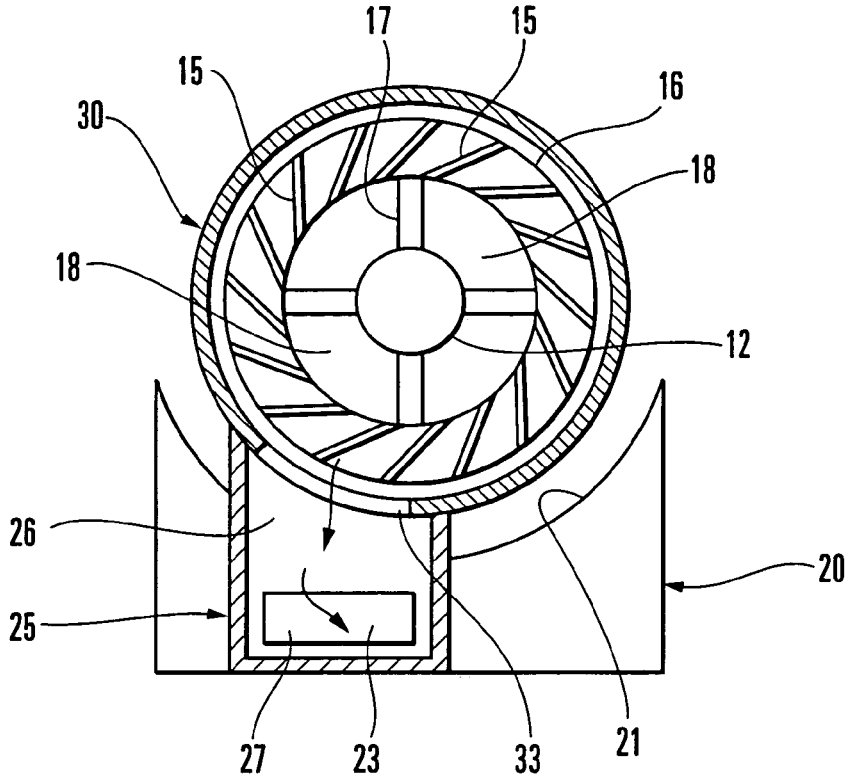
FIG. 5 is a sectional view taken along the line V-V of FIG. 3.

A lateral air blowing guide 20 (sheet guide means) comprising a hollow box slightly longer than the axial length of the transfer cylinder 10 is disposed under the transfer cylinder 10, as shown in FIG. 3. As shown in FIG. 5, the lateral air blowing guide 20 has an arcuate upper surface 21 opposing the rotation locus of the gripper devices 14 of the transfer cylinder 10. The curvature of the upper surface 21 is substantially equal to that of the rotation locus of the gripper devices 14. As shown in FIG. 3, a plurality of air discharge holes 22*a* and 22*b* (discharge ports) are formed in the upper surface 21 to be axi-symmetrical with respect to the center of the widthwise direction (axial direction of the transfer cylinder 10). The air discharge holes 22*a* discharge air in the lateral air blowing guide 20 toward one end side of the transfer cylinder 10 along the upper surface 21. The air discharge holes 22*b* discharge air in the lateral air blowing guide 20 toward the other end side of the transfer cylinder 10 along the upper surface 21. Air inlet ports 23 into which air is introduced from ducts 25 are formed in the two side plates of the lateral air blowing guide 20.

Under the first vane members 15, the box-like ducts 25 are attached to the pair of frames (not shown) through brackets (not shown) to correspond to the first vane members 15. Each duct 25 has an arcuate upper surface 26*a* having the same curvature as that of the outer surface of a corresponding cover 30. An opening 26 is formed in the upper surface 26*a* to correspond to the first vane members 15. An air outlet port 27 is formed in the inner side wall of the duct 25. The lateral air blowing guide 20 is attached between the ducts 25 on the two sides so the air outlet ports 27 communicate with the air inlet ports 23.

The flat cylindrical cover 30 having an opening 31 is attached to the upper surface of the corresponding duct 25 such that the opening 31 faces the rotary body 13. The cover 30 has a through hole 32, on its outer side wall, through which the end of the shaft 12 extends. An opening 33 communicating with the opening 26 of the duct 25 is formed in part of the outer surface of the cover 30.

Sheet guide operation in the sheet guide apparatus having the above arrangement will be described.

Referring to FIG. 1, when the sheet 3 is fed from the feeder 4 onto a feeder board 35, the leading edge of the sheet 3 is aligned. The sheet 3 is transferred to a transfer cylinder 36 by a swing arm shaft pregripper (not shown), gripping-changed to the grippers of the impression cylinder 9 of the first-color printing unit 5A, and conveyed. The sheet 3 under conveyance by the impression cylinder 9 is printed on its surface with the first color while it passes between the impression cylinder 9 and blanket cylinder 8. After that, the sheet 3 is printed on its surface with the second to four colors sequentially by the printing units 5B to 5D. The sheet 3 printed with the four colors is gripping-changed to the delivery pawls of a delivery chain 37 of the delivery unit 6 and drops onto a delivery pile 38 to be stacked there.

While the sheet 3 is being conveyed by the transfer cylinder 10, air discharged from the air discharge holes 22*a* and 22*b* of the lateral air blowing guide 20 regulates the trailing edge of the sheet 3 from fluttering, or coming into contact with the lateral air blowing guide 20 by the centrifugal force. More specifically, when the transfer cylinder 10 rotates, air in the transfer cylinder 10 is taken in by the first vane members 15 from the air suction ports 18 through the openings 31 of the covers 30, and discharged outwardly in the radial directions of the first vane members 15. Air discharged from the first vane members 15 is regulated from diffusing to the sides of the covers 30 by the covers 30 surrounding the first vane members 15 and introduced into the ducts 25 through the openings 33 of the covers 30. After that, air passes through the air outlet ports 27 of the ducts 25 and the air inlet ports 23 of the lateral air blowing guide 20 and is supplied into the lateral air blowing guide 20.

Figure 6:
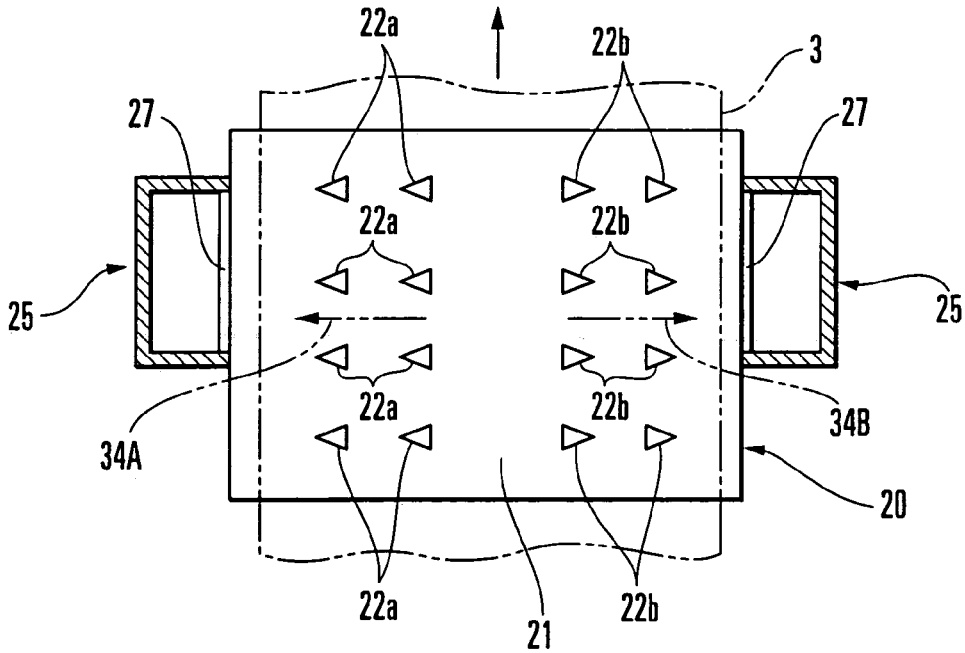
FIG. 6 is a sectional view taken along the line VI-VI of FIG. 3.

Air in the lateral air blowing guide 20 is pressurized by air supplied into the lateral air blowing guide 20, and the pressurized air is discharged from the air discharge holes 22*a* and 22*b*. Air discharged from the air discharge holes 22*a* and 22*b* is discharged toward the two ends of the transfer cylinder 10 along the upper surface 21 of the lateral air blowing guide 20. Air discharged from the air discharge holes 22*a* and 22*b* forms air layers 34A and 34B flowing from the center toward the two end sides in the widthwise direction (the axial direction of the transfer cylinder 10) of the lateral air blowing guide 20, as shown in FIG. 6. As the air layers 34A and 34B are formed between the upper surface 21 of the lateral air blowing guide 20 and the sheet 3 under conveyance, the sheet 3 is conveyed with its trailing edge being in a stable state.

As the first vane members 15 rotate together with the transfer cylinder 10 in this manner, a dedicated driving source for driving the first vane members 15 or an air supply system is unnecessary. When the transfer cylinder 10 rotates, the first vane members 15 also rotate automatically. Thus, a controller which controls the first vane members 15 is also unnecessary. Consequently, the manufacturing cost can be reduced, and the structure can be simplified. As the first vane members 15 are provided to the transfer cylinder 10 to render the driving source, air supply system, and controller unnecessary, the space can be reduced.

Because of the covers 30 which cover the first vane members 15, air discharged from the first vane members 15 does not diffuse but is supplied from the openings 33 of the covers 30 into the lateral air blowing guide 20 through the ducts 25. Thus, air can be efficiently supplied by the first vane members 15. As the pair of first vane members 15 are arranged at the two ends of the transfer cylinder 10, the air supply amount into the lateral air blowing guide 20 can be increased.

Figure 8A:
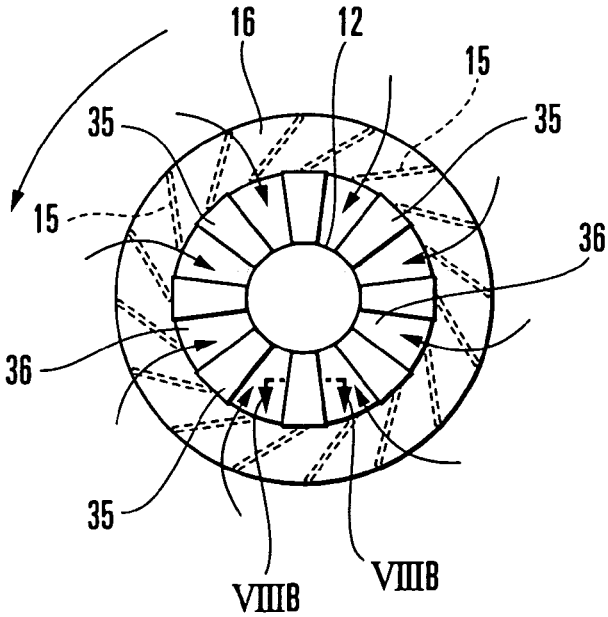
FIG. 8A is a view seen from an arrow VIIIA in FIG. 3 to show the second embodiment of the present invention.
Figure 8B:
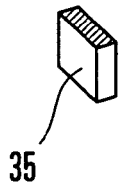
FIG. 8B is a sectional view taken along the line VIIIB-VIIIB in FIG. 8A.

The second embodiment of the present invention will be described with reference to FIGS. 8A and 8B. The second embodiment is different from the first embodiment in that a plurality of second vane members 35 are arranged in place of spokes to connect a shaft 12 to rims 16, and a plurality of air suction ports 36 are formed between the second vane members 35. As shown in FIG. 8B, the second vane members 35 are inclined at predetermined angles (the slip angles of the propellers) inwardly from outside with respect to the rotational direction of the shaft 12. When the shaft 12 rotates, air in a transfer cylinder 10 can be actively taken in by the first vane members 15 through the air suction ports 36.

The second vane members are not limited to flat plate-like members, but may be arcuate members having curved surfaces in place of inclination. Alternatively, the second vane members may be twisted members having different angles of inclination between the rim 16 side and shaft 12 side.

The second vane members 35 are attached to the pair of rims 16 arranged at the two ends of the shaft 12 to be symmetrical. With this arrangement, when the shaft 12 rotates, air is actively taken in by the first vane members 15 through the air suction ports 36, so the air discharge amount by the first vane members 15 increases.

In the above embodiments, the openings 31 of the covers 30 are formed to oppose the rotary body 13 of the transfer cylinder 10. Alternatively, the openings 31 of the covers 30 may open to the opposite side of the rotary body 13. Although air from the air discharge holes 22*a* and 22*b* is discharged toward the two ends in the widthwise direction of the sheet 3, the air discharge direction is not particularly limited. More specifically, air may be discharged toward upstream or downstream in the sheet convey direction, or obliquely toward portions between the sheet convey direction and the two end sides in the widthwise direction of the sheet 3. Alternatively, air may be discharged upward.

In the above embodiments, the sheet 3 is used. Alternatively, a film-type sheet or aluminum sheet may be used. Although the vane members are provided to the transfer cylinder serving as the transport cylinder, the vane members may be provided to a delivery cylinder serving as a transport cylinder. In this case, the sheet guide apparatus may be arranged between the delivery cylinder and a delivery device. Although the lateral air blowing guide 20 serving as the sheet guide apparatus is arranged under the transfer cylinder 10, the present invention is not limited to this. For example, the lateral air blowing guide 20 may be arranged on a side portion of the transfer cylinder 10. It suffices as far as the lateral air blowing guide 20 is arranged close to the transport cylinder.

As has been described above, according to the present invention, the vane members rotate together with the transport cylinder. Therefore, a driving source to drive the vane members, a long air supply system, and a controller for controlling the vane members are unnecessary. Accordingly, the manufacturing cost can be reduced, and the structure can be simplified. As the driving source, air supply system, and controller are unnecessary, the space can be reduced.

What is claimed is:

1. A sheet guide apparatus comprising:

a transport cylinder which conveys a sheet;

a first vane member which is mounted on at least one end of said transport cylinder and rotates integrally with said transport cylinder to discharge air in a radial direction; and sheet guide means, arranged close to said transport cylinder, for discharging air from said first vane member toward the sheet which is conveyed as said transport cylinder rotates, wherein said sheet guide means comprises a box which extends in an axial direction of said transport cylinder and to which air is supplied from said first vane member, said box having a plurality of air discharge ports which open to oppose said transport cylinder to discharge air supplied into said box.

2. An apparatus according to claim 1, wherein the plurality of discharge ports discharge air from a center toward two ends in the axial direction of said transport cylinder.

3. An apparatus according to claim 1, wherein said transport cylinder has a gripper device which grips the sheet, and a surface of said box which opposes said transport cylinder forms an arc having substantially the same curvature as that of a rotation locus of said gripper device.

4. An apparatus according to claim 1, further comprising a cover which surrounds said first vane member, said cover having a first opening through which air is introduced into said cover, and a second opening through which air is led to said box.

5. An apparatus according to claim 4, further comprising a box-like duct which is arranged to correspond to said cover and guides air led from the second opening to said box.

6. An apparatus according to claim 5, wherein said box has an air inlet port in a side wall on one end side of said transport cylinder, said duct has an air outlet port communicating with the air inlet port, and air introduced into said duct through the second opening is supplied into said box through the air outlet port and the air inlet port.

7. An apparatus according to claim 1, wherein said first vane member is inclined at a predetermined angle with respect to a rotational direction and supported at one end of said transport cylinder.

8. An apparatus according to claim 7, wherein said first vane member is inclined at a predetermined angle inwardly from outside in a rotational direction of said transport cylinder and supported at one end of said transport cylinder.

9. An apparatus according to claim 1, further comprising a shaft of said transport cylinder, and a ring-like rim portion which is arranged concentrically with said shaft and rotates integrally with said shaft, wherein said first vane member is attached to said rim portion.

10. An apparatus according to claim 9, further comprising spokes which connect said rim portion to said shaft, wherein air suction ports are formed between adjacent ones of said spokes.

11. An apparatus according to claim 10, wherein said spokes comprise a second vane member which is inclined at a predetermined angle inwardly from outside in a rotational direction of said transport cylinder to supply external air to said transport cylinder.

12. An apparatus according to claim 1, wherein said first vane member comprises a pair of vane members arranged at two ends of said transport cylinder.

* * * * *